US005678658A

United States Patent [19]

Wanner

[11] Patent Number: 5,678,658

[45] Date of Patent: Oct. 21, 1997

[54] LIFTING PLATFORM

[75] Inventor: Hubert Wanner, Seebach, Germany

[73] Assignee: Maha Maschinenbau Haldenwang GmbH & Co.Kg, Haldenwang, Germany

[21] Appl. No.: 525,841

[22] Filed: Sep. 8, 1995

[30] Foreign Application Priority Data

Sep. 8, 1994 [DE] Germany ..... 9414605 U

[51] Int. Cl.[6] ..... B66F 7/28

[52] U.S. Cl. ..... 187/219; 187/221

[58] Field of Search ..... 187/216, 219, 187/221; 254/89 R, 90, 93 UA, 2 B, 2 C

[56] References Cited

U.S. PATENT DOCUMENTS

| | | | |
|---|---|---|---|
| 2,826,269 | 3/1958 | Harr | 187/219 |
| 2,878,897 | 3/1959 | Cochin | 187/219 |
| 2,956,645 | 10/1960 | Halstead | 187/221 |
| 3,330,382 | 7/1967 | Carlson | 187/8.75 |

FOREIGN PATENT DOCUMENTS

| | | | |
|---|---|---|---|
| 240143 | 2/1961 | Australia | 187/221 |
| 0332758 | 12/1988 | European Pat. Off. . | |
| 2699876 | 7/1994 | France | 187/221 |
| 1857620 | 11/1961 | Germany . | |
| 2235068 | 7/1974 | Germany . | |
| 9300989 | 4/1993 | Germany . | |
| 342353 | 12/1959 | Switzerland . | |

*Primary Examiner*—Kenneth Noland

*Attorney, Agent, or Firm*—Baker, Maxham, Jester & Meador

[57] ABSTRACT

A lifting platform for motor vehicles. The platform has easily adjustable support elements mounted on the ends of a beam. The support elements are applied to the pre-designated lifting points on the vehicle for safe lifting thereof.

32 Claims, 2 Drawing Sheets

LIFTING PLATFORM

BACKGROUND

1. Field of the Invention

The invention relates to a lifting platform, and particularly a lifting platform for motor vehicles which is movable and adjustable.

2. Discussion of the Related Art

Lifting platforms are mainly used for carrying out inspection and maintenance work in motor car repair shops. With passenger cars having a supporting body construction it must be taken into consideration that the support elements of the lifting platform must be placed under the lifting points specified by the manufacturer when the vehicles are lifted, as otherwise the vehicle might be damaged and therefore the mechanical integrity of the car body could be affected. Damage to the car body caused by inappropriate lifting can have detrimental effects to the operating characteristics and the precalculated deformation characteristics of the car body in case of an accident. Further, motor vehicles having different axis widths can not be lifted with rigid lifting platforms if these are not specifically designed for a special type of vehicle.

To solve these problems, lifting platforms with pivotable arms are known, the pivoting arms of which must be individually placed in positions under the prescribed lifting points of the vehicle. This pivoting and adjusting process of the pivoting arm is laborious and time consuming. Further the protruding pivoting arms have a relatively large overall height required for stability and require considerable space for so called stand type lifting platforms having two lifting units positioned on the sides.

From the German GM 9,300,989 a lifting platform for motor vehicles is known which has two underfloor pillars, each including a flat beam oriented in the longitudinal or running direction. On the ends of each flat beam, support elements composed of multiple parts are provided, the support plate of which is borne, by way of a cross groove, on the flat beam via an intermediate part and guided in lengthwise and transverse channels. However, due to the usage of the profiled support element this solution is very expensive and is susceptible to significant limitations. In case of a contamination of the guides the support plates become tight, which makes an exact positioning under the vehicle's underbody difficult. Further the movability of the support plates is limited to the lengthwise and transverse directions.

SUMMARY OF THE INVENTION

It is an object of the invention to provide a lifting platform enabling an enhanced adjustability of the support elements with a technically simple formation and low production costs. This object is achieved by the dimensionally stable support elements being directly and tilt resistantly shiftable on the respective end portion of the beam and being borne in a limitedly turnable way.

The support element according to the invention comprises an approximately rectangular hollow space being bordered by the upper support plate and a U-shaped beam integrally formed on the bottom of the upper support plate or fixedly connected to the same in another way. The height of this hollow space is slightly larger than the height of the flat beam, so that the support element on the related end portion of the flat beam can be manually moved without considerable effort. To achieve the desired shiftability in the transverse direction and the turnability of the support element, the width of the hollow space is greater than the width of the flat beam by the maximum transverse shifting amount. The maximum adjusting movements are limited by stoppers formed by the side or end walls of the U-shaped beam or separate stopper elements, or both.

As the support element rests directly on the flat beam without intermediate parts, the desired simple construction is achieved. Further, the support element can not only be shifted in the lengthwise and transverse directions, but also adjusted obliquely by a limited turn, which enables a particularly simple and accurate positional adjustment to the respective lifting points of a vehicle's body.

The support elements formed in accordance with the invention can be used with different types of lifting platforms, for example in lifting pillar type or pillar type design with transverse or longitudinal beams as well as with pivotable arms.

The support element according to the invention includes a U-shaped bottom part encompassing the beam, as well as a support plate for the vehicle directly resting on the flat beam. In an unloaded state the support element can be moved in lengthwise and transverse directions as well as turned to an oblique position by the operator without a considerable effort.

The adjustment of the support elements is effected before the vehicle is driven onto the lifting platform or before the motor vehicle, which has been moved onto the platform, is lifted. By raising the beams the motor vehicle is lifted, a slight tilt of the support element on the flat beam being sufficient to ensure a safe support of the vehicle on the lifting platform. The dimensioning of the allowance between the inside of the support element and the beam is limited by the tilt angle of the support element.

To limit the movements of the support element, stopper bolts can be used, which are screwed into the beam after having shifted the support element, and which come to rest on a stopper ridge fixed in the support element when the support element is fully extended, so that the support elements cannot be extended beyond a maximum length. The oblique position of the support element is limited by the width of the U-shaped beam and the flat beam.

Suitably, the support plate has the oblique side and front edges facilitating the ascent of the motor vehicle onto the platform. Further, the support elements may have rubber feet under the oblique edges and at the sides of the U-shaped beam, which rest on the floor when the lifting unit is fully retracted and receive the stresses generated by motor vehicles being driven on.

Thus, according to the invention, an accurate and jam-free adjustment can be realized by a simple construction with low production costs, which even allows for a turn of the support element.

BRIEF DESCRIPTION OF THE DRAWING

The objects, advantages and features of this invention will be more clearly perceived from the following detailed description, when read in conjunction with the accompanying drawing, in which.

DETAILED DESCRIPTION OF THE PREFERRED EMBODIMENTS

Figure 1:
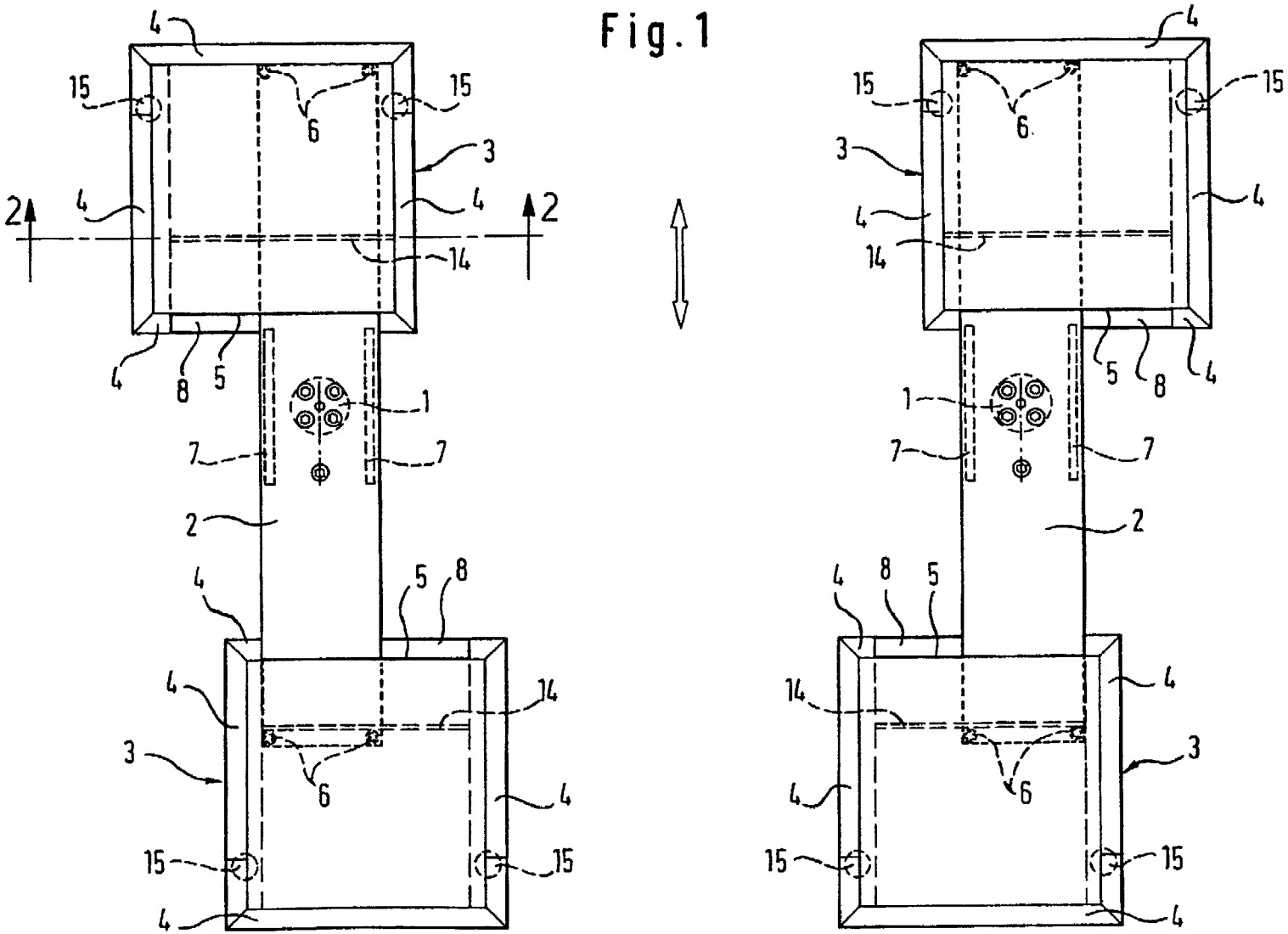
FIG. 1 is a schematic plan view of a two-pillar lifting platform comprising two flat beams having support elements arranged on the end portions thereof, as taught by the invention.

The lifting platform for four-wheeled, or two-track, motor vehicles, particularly passenger cars, which is schematically shown in FIG. 1, comprises two underfloor lifting pillars 1 of known construction, on the upper end of which flat beam 2, extending parallel to the running direction, is rigidly mounted respectively, for example, by four bolts each. On each end portion of the two flat beams 2 a considerably wider support element 3 is provided, which may have a square, rectangular or even rounded shape in a plan view. Suitably-but not necessarily-the four support elements 3 are equally formed.

As shown, each support element 3 comprises oblique side edges 4 forming leading ramps as well as having a receiving opening 5 on one side, through which the respective end portion of flat beam 2 protrudes into the inner hollow space of the support element. Two stopper bolts 6 are screwed into the ends of flat beams 2, respectively, which, among other functions, limit the maximum extension path of each support element 3 and prevent it from being pulled off altogether. Further, two parallel stopper ridges 7 are mounted on the bottom side of each flat beam 2, the ends of which are positioned to engage the protruding lower edge 8 of the respective support element 3 and limit the maximum amount by which the beam and support element combination can be shortened.

Figure 2:
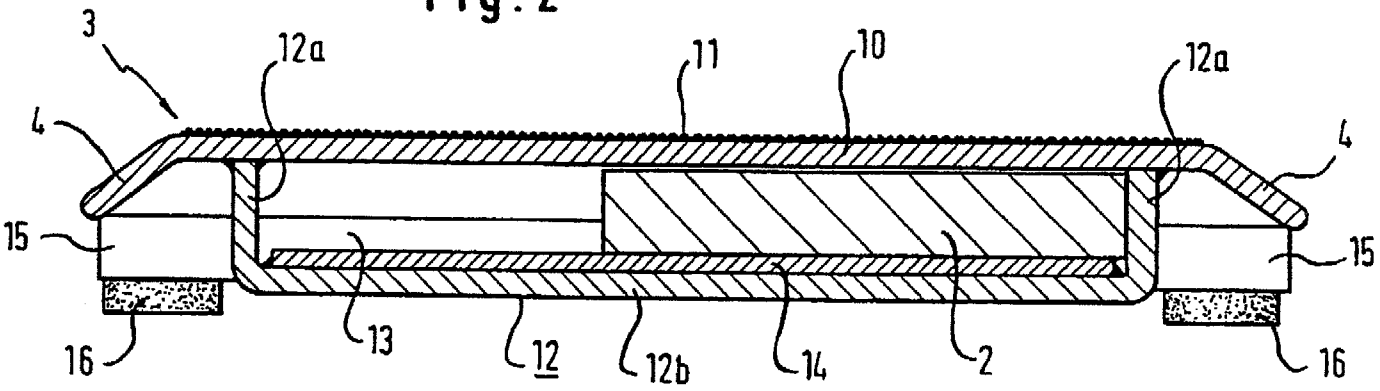
FIG. 2 is an enlarged cross sectional view of a support element of the apparatus, taken along cutting plane 2—2 of FIG. 1.

Support element 3 shown in FIG. 2 in an enlarged cross sectional view comprises upper support plate 10 which includes antiskid cover 11 and has downwardly bent edges 4. Dimensionally stable U-shaped member 12 is rigidly fixed to the bottom side of support plate 10, for example, by welding. U-shaped member 12 defines, together with support plate 10, hollow space 13, the height of which is slightly greater than the thickness of flat beam 2 received in this hollow space for relative movability in a horizontal direction. The width of hollow space 13, which has an approximately rectangular configuration, is much greater than the width of flat beam 2, so that support element 3 on flat beam 2 can be continuously shifted from its illustrated left end position to the right, until left bridge 12*a* of U-shaped member 12, according to FIG. 2, rests on the left side edge of the flat beam. On center bridge 12*b* of U-shaped member 12 transverse ridge 14 is fixed, for example, by welding, which forms an end stopper for bolts 6 shown in FIG. 1 and limits the extension movement of support element 3 in the lengthwise or running direction.

Figure 3:
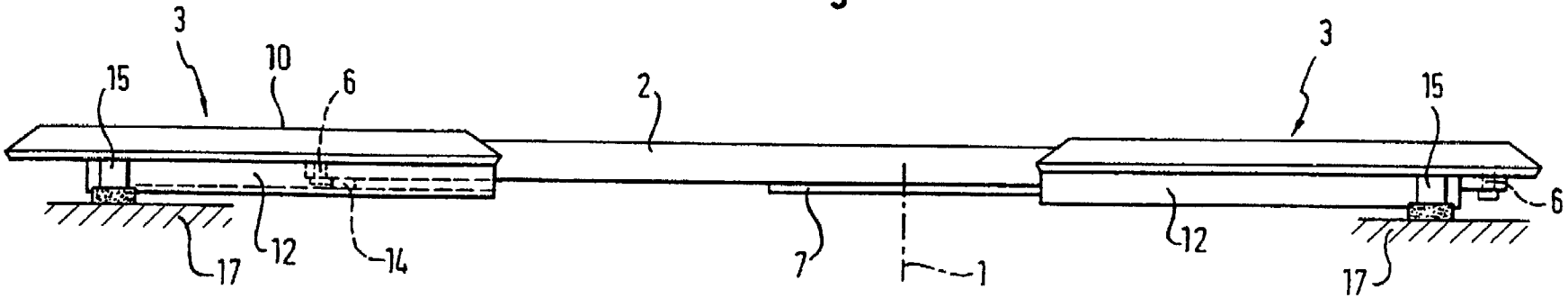
FIG. 3 shows one of the flat beams of FIG. 1 and its two support elements in side view.

Adjacent to both sides of U-shaped member 12, two feet 15 with rubber paddings 16 are fixed under protruding edges 4 of support plate 10 protruding beyond the lower edge of U-shaped member 12 and rest on the ground 17, when lifting pillar 1 is fully retracted (see FIG. 3). Further, as can be seen from FIG. 3, U-shaped members 12 of support elements 3 are shorter than support plates 10, so that, when a support element 3 is fully retracted, the end of flat beam 2 protrudes beyond U-shaped member 12 and bolts 6 can be screwed in the threaded bores provided in flat beam 2 in a simple way, as it is possible with the right support element 3 according to FIG. 3.

The present invention is not limited to the embodiment shown. For example, other lifting units can be provided instead of lifting pillars 1. Further, flat beam 2 can also be a traverse beam or may be formed as a pivotable arm and have different cross sectional shapes. However, its end portion coming into contact with support element 3 should be provided with flat contact surfaces. Additionally, a sliding means can be provided between the contact surfaces of flat beam 2 and support plate 10. Finally, support element 3 can be fixable to flat beam 2 in a desired position, which can be achieved by stretching bolts or a clamping mechanism.

What is claimed is:

1. A lifting platform, particularly for two-track motor vehicles, comprising:

at least one lifting unit;

at least one elongated beam fixed to said lifting unit and having beam stopper elements, said beam having opposite flat end portions; and support elements provided on said flat end portions of said beam, said support elements being shaped and configured with respect to said beam end portion to permit limited rotation and to resist tilting while permitting longitudinal and transverse horizontal motion;

each said support element having an upper support plate and a U-shaped member secured to said upper support plate to form a hollow space therewith for movably receiving said flat end portion of said beam, wherein the height of said hollow space is slightly greater than the thickness of said beam, and wherein the width of said hollow space is substantially greater than the width of said end portion of said beam by the amount of the permitted maximum transverse movement of said support element, and wherein said U-shaped member is provided with inner stopper elements and is shorter than said upper support plate, and wherein contacts between said inner stopper elements and said beam stopper elements limits longitudinal and retracting movements of said support element on said beam.

2. The lifting platform recited in claim 1, wherein said U-shaped member is formed with inner first stopper elements and said beam has second stopper elements thereon, whereby contact between said first and second stopper elements limits longitudinal and retraction movements of said support element on said beam.

3. The lifting platform recited in claim 1, wherein said beam is formed with third stopper elements, which limit the retracting movement of said support element upon contacting said U-shaped member.

4. The lifting platform recited in claim 2, wherein said beam is formed with third stopper elements, which limit the retracting movement of said support element upon contacting said U-shaped member.

5. The lifting platform recited in claim 1, and further comprising downwardly protruding feet on each said support element.

6. The lifting platform recited in claim 1, and further comprising downwardly protruding feet on each said support element.

7. The lifting platform recited in claim 1, and further comprising downwardly protruding feet on each said support element.

8. The lifting platform recited in claim 1, and further comprising downwardly protruding feet on each said support element.

9. The lifting platform recited in claim 2, and further comprising downwardly protruding feet on each said support element.

10. The lifting platform recited in claim 1, wherein said support plate is rooflike and has a partly roughened surface.

11. The lifting platform recited in claim 1, wherein said support plate is rooflike and has a partly roughened surface.

12. The lifting platform recited in claim 1, wherein said beam is flat.

13. The lifting platform recited in claim 1, wherein said beam is flat.

14. A lifting platform, particularly for two-track motor vehicles, comprising:

at least one lifting unit;

at least one elongated beam fixed to said lifting unit, said beam having opposite end portions;

support elements provided on said end portions of said beam and being horizontally movable thereon, each said support element having a support plate and being manually adjustable in lengthwise and transverse directions; and means for limiting the horizontal movement of said support element on said beam;

said support element being shaped and configured with respect to said beam end portion to permit limited rotation and to resist tilting while permitting longitudinal and transverse horizontal motion, wherein said support element is formed with a hollow space under said support plate for movably receiving said end portion of said beam, the height of said hollow space being greater than the thickness of said beam, and the width of said hollow space being greater than the width of said end portion of said beam by the amount of the permitted maximum transverse movement of said support element, and wherein said support element has a U-shaped member secured to said support plate to form a hollow space therewith, and wherein said U-shaped member is shorter than said support plate.

15. The lifting platform recited in claim 14, wherein said U-shaped member is formed with inner first stopper elements and said beam has second stopper elements thereon, whereby contact between said first and second stopper elements limits longitudinal movement of said support element on said beam.

16. The lifting platform in claim 14, wherein said beam is formed with third stopper elements, which limit the retracting movement of said support element upon contacting said U-shaped member.

17. The lifting platform recited in claim 14 and further comprising downwardly protruding feet on each said support element.

18. A lifting platform, particularly for two-track motor vehicles, comprising:

at least one lifting unit;

at least one elongated beam fixed to said lifting unit, said beam having opposite end portions;

support elements provided on said end portions of said beam and being horizontally movable thereon, each said support element having a support plate and being manually adjustable in lengthwise and transverse directions; and means for limiting the horizontal movement of said support element on said beam;

said support element being shaped and configured with respect to said beam end portion to permit limited rotation and to resist tilting while permitting longitudinal and transverse horizontal motion, wherein said support element is formed with a hollow space under said support plate for movably receiving said end portion of said beam, the height of said hollow space being greater than the thickness of said beam, and the width of said hollow space being greater than the width of said end portion of said beam by the amount of the permitted maximum transverse movement of said support element, and wherein said support element has a U-shaped member secured to said support plate to form a hollow space therewith, and wherein said U-shaped member is formed with inner first stopper elements and said beam has second stopper elements thereon, whereby contact between said first and second stopper elements limits longitudinal movement of said support element on said beam.

19. The lifting platform recited in claim 18, wherein said U-shaped member is formed with inner first stopper elements and said beam has second stopper elements thereon, whereby contact between said first and second stopper elements limits longitudinal movement of said support element on said beam.

20. The lifting platform in claim 18, wherein said beam is formed with third stopper elements, which limit the retracting movement of said support element upon contacting said U-shaped member.

21. The lifting platform recited in claim 18 and further comprising downwardly protruding feet on each said support element.

22. A lifting platform, particularly for two-track motor vehicles, comprising:

at least one lifting unit;

at least one elongated beam fixed to said lifting unit, said beam having opposite end portions;

support elements provided on said end portions of said beam and being horizontally movable thereon, each said support element having a support plate and being manually adjustable in lengthwise and transverse directions; and means for limiting the horizontal movement of said support element on said beam;

said support element being shaped and configured with respect to said beam end portion to permit limited rotation and to resist tilting while permitting longitudinal and transverse horizontal motion, wherein said support element has a U-shaped member secured to said support plate to form a hollow space therewith, and wherein said U-shaped member is formed with inner first stopper elements and said beam has second stopper elements thereon, whereby contact between said first and second stopper elements limits longitudinal movement of said support element on said beam.

23. The lifting platform recited in claim 22, wherein said beam is formed with third stopper elements, which limit the retracting movement of said support element upon contacting said U-shaped member.

24. The lifting platform recited in claim 22 and further comprising downwardly protruding feet on each said support element.

25. A lifting platform, particularly for two-track motor vehicles, comprising:

at least one lifting unit;

at least one elongated beam fixed to said lifting unit, said beam having opposite end portions;

support elements provided on said end portions of said beam and being horizontally movable thereon, each said support element having a support plate and being manually adjustable in lengthwise and transverse directions; and means for limiting the horizontal movement of said support element on said beam;

said support element being shaped and configured with respect to said beam end portion to permit limited rotation and to resist tilting while permitting longitudinal and transverse horizontal motion, wherein said support element is formed with a hollow space under said support plate for movably receiving said end portion of said beam, the height of said hollow space being greater than the thickness of said beam, and the width of said hollow space being greater than the width of said end portion of said beam by the amount of the permitted maximum transverse movement of said support element, and wherein said support element has a U-shaped member secured to said support plate to form a hollow space therewith, and wherein said beam is formed with third stopper elements, which limit the retracting movement of said support element upon contacting said U-shaped member.

26. The lifting platform recited in claim 25, wherein said beam is formed with third stopper elements, which limit the retracting movement of said support element upon contacting said U-shaped member.

27. The lifting platform recited in claim 25, and further comprising downwardly protruding feet on each said support element.

28. A lifting platform, particularly for two-track motor vehicles, comprising:

at least one;

at least one elongated beam fixed to said lifting unit, said beam having opposite end portions;

support elements provided on said end portions of said beam and being horizontally movable thereon, each said support element having a support plate and being manually adjustable in lengthwise and transverse directions; and means for limiting the horizontal movement of said support element on said beam;

said support element being shaped and configured with respect to said beam end portion to permit limited rotation and to resist tilting while permitting longitudinal and transverse horizontal motion, and wherein said support element has a U-shaped member secured to said support plate to form a hollow space therewith, and wherein said beam is formed with third stopper elements, which limit the retracting movement of said support element upon contacting said U-shaped member.

29. The lifting platform recited in claim 15, wherein said beam is formed with third stopper elements, which limit the retracting movement of said support element upon contacting said U-shaped member.

30. The lifting platform recited in claim 19, wherein said beam is formed with third stopper elements, which limit the retracting movement of said support element upon contacting said U-shaped member.

31. The lifting platform recited in claim 15 and further comprising downwardly protruding feet on each said support element.

32. The lifting platform recited in claim 19, and further comprising downwardly protruding feet on each said support element.

* * * * *